United States Patent [19]

Shaffer

[11] Patent Number: 4,810,221

[45] Date of Patent: Mar. 7, 1989

[54] METHOD FOR GETTERING INCANDESCENT LAMPS

[75] Inventor: John W. Shaffer, Montoursville, Pa.

[73] Assignee: GTE Products Corporation, Danvers, Mass.

[21] Appl. No.: 153,862

[22] Filed: Feb. 9, 1988

[51] Int. Cl.[4] ..... H01J 9/38

[52] U.S. Cl. ..... 445/9; 445/55; 445/53

[58] Field of Search ..... 445/9, 38, 41, 53, 55; 313/557, 562

[56] References Cited

U.S. PATENT DOCUMENTS

| | | | |
|---|---|---|---|
| 1,166,464 | 1/1916 | Liebmann | 445/9 |
| 1,269,520 | 6/1918 | Blau | 445/9 |
| 1,560,981 | 11/1925 | De Graaff | 445/9 |
| 1,648,677 | 11/1927 | De Boer | 313/557 |
| 1,944,825 | 12/1929 | Millner | 445/55 |
| 3,510,189 | 5/1970 | Larson | 445/9 |
| 3,585,435 | 6/1971 | T'Jampens | 313/557 |
| 4,005,324 | 1/1977 | Dolenga et al. | 445/53 |
| 4,024,425 | 5/1977 | Higashi et al. | 313/562 |
| 4,213,662 | 7/1980 | Giller et al. | 445/53 |
| 4,727,286 | 2/1988 | Keenan et al. | 313/557 |

*Primary Examiner*—Kurt Rowan

*Attorney, Agent, or Firm*—Martha Ann Finnegan

[57] ABSTRACT

This invention relates to incandescent lamps and more particularly to the gettering of such lamps. In accordance with the present invention there is provided an improved method of gettering an incandescent lamp. The method comprises introducing a fill gas and a getter compound comprising a borane compound, or a partially halogenated derivative thereof, into an unsealed lamp envelope; sealing the lamp envelope; and heating the sealed envelope, for a sufficient period of time, and at a temperature sufficient to activate the getter to perform its desired gettering function prior to the thermal decomposition thereof.

11 Claims, 2 Drawing Sheets

METHOD FOR GETTERING INCANDESCENT LAMPS

BACKGROUND OF THE INVENTION

This invention relates to incandescent lamps and more particularly to the gettering of such lamps.

The operating life of an incandescent lamp is greatly shortened by the presence of oxygen, carbon dioxide, and/or water vapor in the lamp atmosphere. Water vapor is particularly harmful because even trace amounts "catalyze" the evaporation of the tungsten filament coil by means of the well known "water cycle."

In the water cycle, the temperature at the tungsten coil is thermally sufficient to decompose water vapor into hydrogen and oxygen. The resulting oxygen reacts with the tungsten in the coil to form volatile oxides which migrate to cooler parts of the lamp and condense. These oxide deposits are reduced by the gaseous hydrogen to yield black metallic tungsten and reformed water, which causes the cycle to repeat.

The problems introduced by excess oxygen in incandescent lamps are likewise well known. For example, in the tungsten-halogen cycle, oxygen is the primary agent of attack on the tungsten filament. This attack may result in etching, and dendritic growth, and usually causes early filament failure. While an extremely small amount of oxygen is commonly accepted as a necessary constituent in the lamp, the amount which ends up in a finished tungsten-halogen capsule is generally recognized as being extremely variable and is always considered to be excessive. The presence of this "necessary constituent" has long been recognized as a major impediment to the fabrication of longer lived and more consistently performing tungsten-halogen lamps.

A commonly utilized solution to the oxygen problem in tungsten-halogen lamps is the introduction of one or more compounds into the lamp which will remove the excess oxygen and prevent its participation in the tungsten-halogen cycle. Such compounds are commonly referred to as oxygen getters.

Various oxygen getters and/or gettering systems have been used previously. For example, metallic getters such as tantalum, zirconium, niobium, copper, hafnium, titanium, aluminum, or various combinations thereof, have been employed as oxygen getters. Metallic getters may be attached to a portion of the filament mount within the lamp, e.g., in the form of a crimped piece of metal. These metal getters may also be incorporated as an alloy in the molybdenum leads which support the filament within the lamp.

U.S. Pat. No. 4,305,017 describes the use of the above-identified metals together with precious metals such as palladium, platinum and gold as oxygen getters. Metal flags, such as those described in the '017 patent, tend to be difficult and expensive to attach to the internal structure of a tungsten-halogen lamp. Also, some metallic getters that are used in incandescent lamps are not applicable for use in tungsten halogen lamps because they will react with the halogen and terminate the desired halogen cycle. Likewise, the fabrication of specialized getter alloys can also add considerably to the cost of manufacturing a tungsten-halogen lamp. In addition, in certain lamp types, it is desirable for the getter to be present across the entire range of locations within the lamp. Such positioning is impossible with metallic flag getters, and/or metal alloy gettering systems, which are generally limited to specific discrete locations.

Another commonly used oxygen getter for incandescent lamps is phosphorus. Phosphorus oxides which are formed by the gettering of oxygen are volatile, even at the cold spot temperatures found in hot operating incandescent lamps, including tungsten-halogen lamps.

Phosphorus can be deposited in a lamp, for example, on either the filament mount and/or the coil itself, e.g., by dipping a suspension of red phosphorus or $P_3N_5$ in a suitable solvent. Alternatively, phosphorus can be deposited on the filament by evaporative coating of red phosphorus.

Phosphorus can also be introduced into incandescent lamps as phosphine gas ($PH_3$), which is thermally decomposed into phosphorus and hydrogen by the heat of the coil at light-up.

Another oxygen getter which has been employed in incandescent lamps is the carbon getter. Carbon getters may be introduced to the lamp as part of a hydrogenated hydrocarbon gas or as carbon monoxide. However, in addition to deleteriously affecting filament life in certain lamp types, carbon has failed to perform as expected as an oxygen getter.

Yet another oxygen gettering system is described in U.S. Pat. No. 1,944,825. This patent teaches and claims the use of various gaseous fluoride compounds having water-absorbing properties. The list of fluoride compounds includes $SiF_4$, $BF_3$, $AsF_3$, $PF_3$, and salts thereof.

New gettering systems are constantly being developed. The present invention represents another such advance in this art.

SUMMARY OF THE INVENTION

A gettering system, such as the gettering system of the present invention, wherein gettered oxygen is bound in a permanent, nonvolatile form, so that the getter is effective in even the hottest operating lamps, clearly represents an advance in this art.

In accordance with the present invention there is provided a method of gettering an incandescent lamp. The method comprises introducing a fill gas and a getter comprising a borane compound, or a partially halogenated derivative thereof, into an unsealed lamp envelope; sealing the lamp envelope; and heating the sealed envelope, for a sufficient period of time, and at a temperature sufficient to activate the getter.

As used herein, the terms "partially halogenated derivatives" refers to borane compounds wherein one or more, but less than all, of the hydrogens have been replaced by a halogen, i.e., F, Cl, Br, and/or I. Preferably the replacement is accomplished by bromine. It must be noted that in the method of the present invention, one hydrogen atom must always be present in the "partially halogenated derivatives" of the borane compounds.

During the getter activation step of the present method, the getter is heated sufficiently to be "activated." The temperature and time required to "activate" the getter must be below the temperature and time which would otherwise cause decomposition of the getter prior to its performing the desired gettering function. In fact, when temperatures and/or heating times sufficient to cause premature decomposition of the getter compound are employed, the getter compositions recited above fail to function.

During the getter activation step, the borane compound getter reacts with residual impurities such as oxygen, water, etc., present in the sealed envelope, forming by-products including nonvolatile boron oxide and hydrogen. When a partially halogenated derivative of the borane compound getter is employed as the getter, such by-products further include halogen compounds, e.g., $Br_2$, $I_2$, and the like.

Advantageously, in the method of the present invention, the getter removes any oxygen impurity from the envelop by binding the oxygen in a stable, nonvolatile form, e.g., as boron oxide ($B_2O_3$), which does not decompose (and liberate oxygen) under the high operating temperatures of the lamp.

For a better understanding of the present invention, together with other and further advantages and capabilities thereof, reference is made to the figures accompanying this specification, the following detailed description and the claims appended hereto.

DETAILED DESCRIPTION

Figure 1:
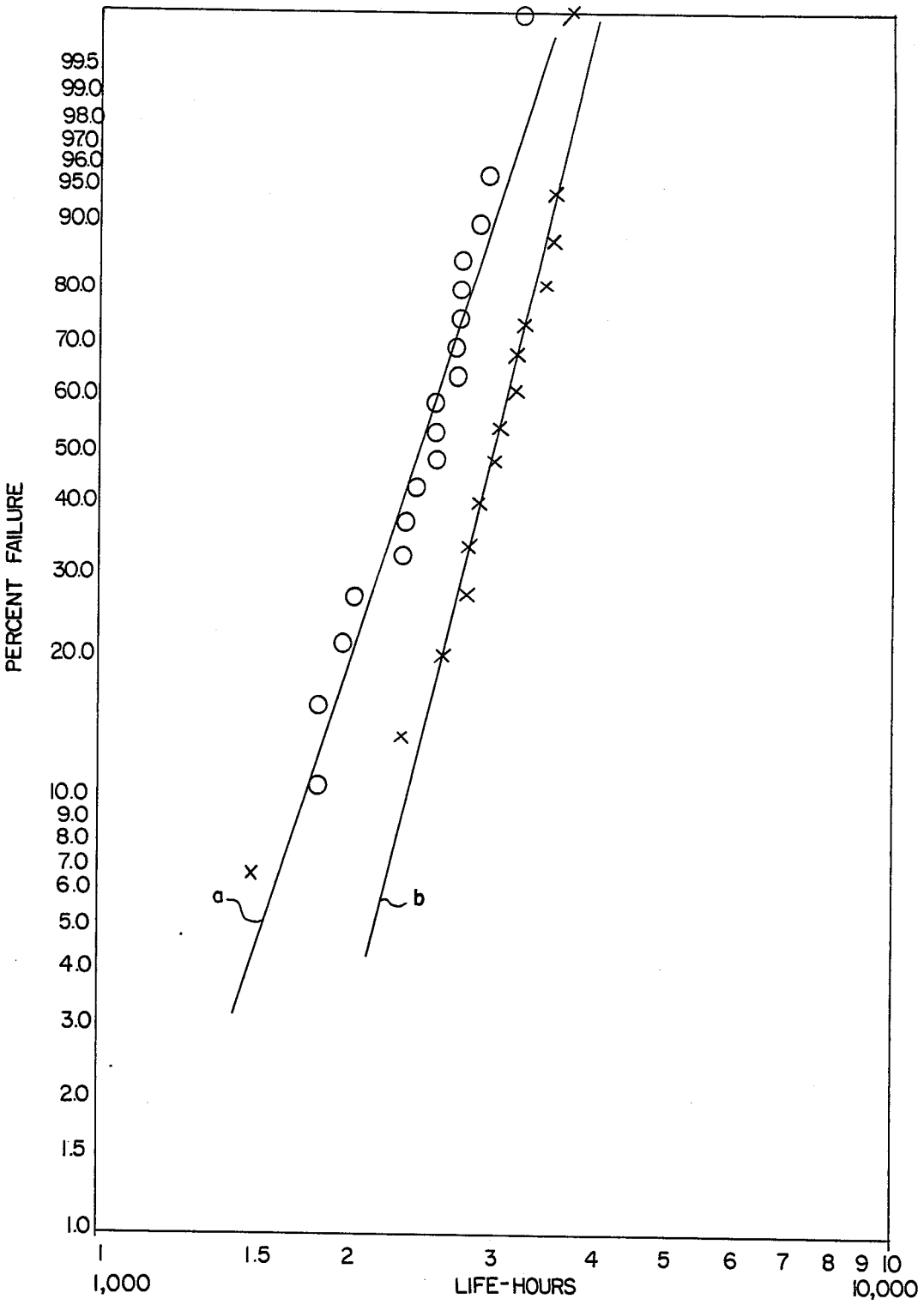
FIGS. 1 and 2 compare lamp test data for lamps fabricated using a phosphine getter against lamps fabricated using a getter comprising silane.

The present invention is directed to an improved method of gettering incandescent lamps.

Incandescent lamps are well known in the lighting art. Such lamps typically include an hermetically sealed light pervious envelope such as quartz or hard glass, containing a fill gas. Typical fill gases include a halogen and an inert gas. Such fill gases may further include hydrogen. The principal function of the fill gas in incandescent lamps is to retard evaporation of the coil. In some lamps the fill gas may perform the additional secondary function of suppressing the arc. The envelope also includes a filament wire, such as tungsten wire, which is in electrical connection with lead-in wires sealed into and extending internally and externally of the lamp envelope. Such lead-in wires may extend from opposite ends of the envelope(double-ended lamp) or from the same end of the envelope (single-ended lamp). Such lamps may further be enclosed within an outer envelope or a parabolic reflector and a lens.

The present method removes residual impurities from the lamp after introducing the fill gas into the lamp envelope and sealing the lamp. Such sealing step, commonly referred to in the art as "tipping off," is a routine step in the fabrication or manufacture of incandescent lamps.

The method of the present invention includes introducing a fill gas and a getter comprising a borane compound, or a partially halogenated derivative thereof, into an unsealed lamp envelope comprising a light pervious envelope having a filament wire therein, the filament wire being in electrical connection with lead-in wires which are sealed into and extend internally and externally from the lamp envelope.

Preferably, the gaseous getter is introduced into the lamp envelope as a minor component of the fill gas. Alternatively, the fill gas and gaseous getter are separately introduced into the lamp.

After the fill gas and getter have been introduced into the lamp envelope, the lamp is sealed by conventional lamp sealing techniques.

After the lamp has been sealed, the lamp is heated at a temperature, and for a period of time, sufficient to activate the getter, so as to convert residual impurities in the lamp into materials which are inert or nondetrimental to the chemical cycle of the lamp.

One example of a method for using a borane getter is to introduce it as a minor component of the fill gas. After the lamp has been tipped off, i.e., sealed, it is subjected to a bake cycle to activate the getter. During this bake cycle, the borane reacts, essentially quantitatively, with any oxygen in the lamp to form nonvolatile boron oxide ($B_2O_3$) and hydrogen. When the lamp is lighted after this bake cycle, any oxygen liberated from the coil is consumed and the residual excess borane is thermally decomposed.

In tungsten-halogen incandescent lamps, borane may react with halogen in the fill gas to form volatile haloboranes, which are as effective for gettering oxygen as borane itself. For example, in a lamp containing HBr as a fill component, monobromoborane is formed, assuming borane is introduced into the lamp in stoichiometric excess.

Examples of borane compounds for use in the present method include: $B_2H_6$, diborane (6); $B_4H_{10}$, tetraborane (10); $B_5H_9$, pentaborane (9); $B_5H_{11}$, Pentaborane (11); $B_6H_{10}$, hexaborane (10); and $B_6H_{12}$, hexaborane (12), as well as their various respective partially halogenated derivatives.

Appropriate getter activation temperatures are preferably from about 100° C. to about 1000° C., and most preferably in the area of from 300° C. to 500° C. Lower temperatures promote more gradual release of adsorbed water and significantly lower gettering reaction rates. The optimum activation time and temperature will vary with the specific chemical getter used, from among those listed herein, and on the particular lamp construction being made. Some lamps contain internal structures that heat slowly by external heating and would therefore require a longer time at a given temperature for optimum gettering action to occur.

In like manner the optimum quantity of gettering additive will depend on the lamp internal volume, fill pressure, internal surface area, and the specific getter used. Depending upon lamp internal volume, fill pressure, and other variables, effective gettering action in accordance with the teachings of this invention can be attained over a concentration range of from about 0.001 percent to five percent getter additive by volume. At lower levels there may not be sufficient additive present to react with all the contaminants present. High excesses will promote undesired light loss due to the formation of elemental boron within the lamp. As lamp surface area increases, as for example in an inside frosted or smoked bulb, more getter will be needed because of the relatively higher quantity of adsorbed moisture present. From the examples given, those skilled in the art of lampmaking can quickly arrive at appropriate getter additive levels for specific lamps of interest.

In accordance with the present invention, it is believed that borane compounds, also referred to in the art as boron hydride compounds, and partially halogenated derivatives thereof will provide advantages similar to that obtained with getters comprising silane compounds and partially halogenated derivates thereof. For a general discussion regarding borane compounds, their chemistry and structures, see Cotton and Wilkinson, *Advanced Inorganic Chemistry,* John Wiley & Sons (4th Ed. 1980) pp. 303–315, the content of which is hereby incorporated herein by reference. Elemental boron and silicon are analogous in that they both form volatile hydrides that are pyrophoric, that is, they ignite spontaneously upon contact with air. In fact, these boron and hydrogen containing compounds are expected to perform functionally superior to the silanes based upon their comparative thermochemistry.

The use of silane compounds and partially halogenated derivatives thereof may be preferred, however, because they are less hazardous to work with, particularly in a non-laboratory, production oriented lamp manufacturing plant. The boranes have positive heats of formation (in contrast to silane) and are accordingly unstable chemicals that can violently decompose, especially in concentrated or pure forms. In addition to this instability, the boranes are significantly more toxic than are the silanes. For example, the threshold limit valves (TLV's) published in 1984–5 by the American Conference of Governmental Industrial Hygienists, lists time-weights average (TWA) exposures of 0.1 for diborane and 5.0 for silane. These values represent parts per million in air "for a normal 8-hour workday and a 40 hour workweek, to which nearly all workers may be repeatedly exposed, day after day, without adverse effect." The 50-fold difference in TWA's shows the significantly higher hazard level in working with boranes. Nevertheless, boranes and haloboranes will function as highly effective oxygen getters for incandescent lamps. It should be emphasized, however, that neither silanes nor boranes would remain in the finished lamps after the light-up step included in the manufacturing process, and that no toxic or other hazards would exist in use or handling of the finished lamps.

The getters taught herein can, of course, be used together with other known getters such as, for example, phosphorus, if so desired.

While the following Examples are directed to lamps fabricated by a method which includes introducing a silane getter into an incandescent lamp, a method in accordance with the present invention, employing a getter comprising a borane compound or partially halogenated derivative thereof, will behave in an analagous manner.

EXAMPLE I

By way of a specific example, 52 watt, 84 volt tungsten halogen capsules were fabricated from 10 mm o.d. aluminosilicate tubing and had a nominal internal volume of 1.1 cubic centimeters. The fill gas was introduced to a pressure of five atmospheres and comprised 0.1 percent hydrogen bromide, 2.0 percent nitrogen, and the balance xenon. The coils were of straight coiled coil design wound from no-sag tungsten wire having a wire weight of 9.28 mg/200 mm, and wound so as to produce an efficacy of 16.6 lumens per watt. The finished capsules were mounted in outer bulbs with a diode in electrical series with the coil for life testing at 120 volts AC. These lamps were similar in construction to the Sylvania Capsylite A-Line lamp.

One group of capsules used no getter. A second group contained phosphorus, formed in the capsule before final evacuation by the thermal cracking (with electrical heating of the coil) of a one percent mixture of phosphine in nitrogen at a pressure of approximately 925 millimeters of mercury. The third group used no phosphine, but instead included a fill gas containing 0.083 volume percent silane in addition to the other gases.

The lamps were operated equally in the base up, base down, and horizontal attitudes on the life rack. The results are summarized in Table I below, and in FIG. 1.

TABLE I

| Getter | No. Lamps | Avg. Life | Range |
|---|---|---|---|
| None | 18 | 2038 Hours | 581–3553 Hours |
| Phosphine | 19 | 2611 Hours | 1851–3484 Hours |
| Silane | 15 | 3143 Hours | 1519–4041 Hours |

In FIG. 1, curve a illustrates the data for the control lamps fabricated with a phosphine getter, while curve b illustrates the data for lamps fabricated in accordance with the present invention.

In this test, silane showed a life improvement of 54 percent over no getter, and 20 percent over the commonly used phosphorus getter.

EXAMPLE II

In a second test, 45 watt, 84 volt tungsten halogen capsules were fabricated from 12.5 mm o.d. aluminosilicate tubing and had a nominal internal volume of 2.0 cubic centimeters. The fill gas was introduced to a pressure of five atmospheres and comprised 0.1 percent hydrogen bromide, 2.0 percent nitrogen, and the balance xenon. The coils were of straight coiled coil design wound from no-sag tungsten wire having a wire weight of 7.47 mg/200 mm, and wound so as to produce an efficacy of 16.5 lumens per watt. The finished capsules were mounted in PAR-38 lamps with a diode in electrical series with the coil. The lamps were life tested at 120 volts AC.

One group of capsules contained phosphorus, formed in the capsule before final evacuation by the thermal cracking of a one percent mixture of phosphine in nitrogen at 925 millimeters of mercury pressure by electrically heating the coil. A second group of capsules used 0.083 volume percent silane in the fill gas instead of phosphorus.

The lamps were mounted on the life rack and divided between 45 degrees base up, horizontal, and 45 degrees base down burning positions. The results are shown in Table II, below, and in FIG. 2.

TABLE II

| Getter | No. Lamps | Avg. Life | Range |
|---|---|---|---|
| Phosphine | 21 | 1616 Hours | 827–2333 Hours |
| Silane | 44 | 2358 Hours | 632–4627 Hours |

Figure 2:
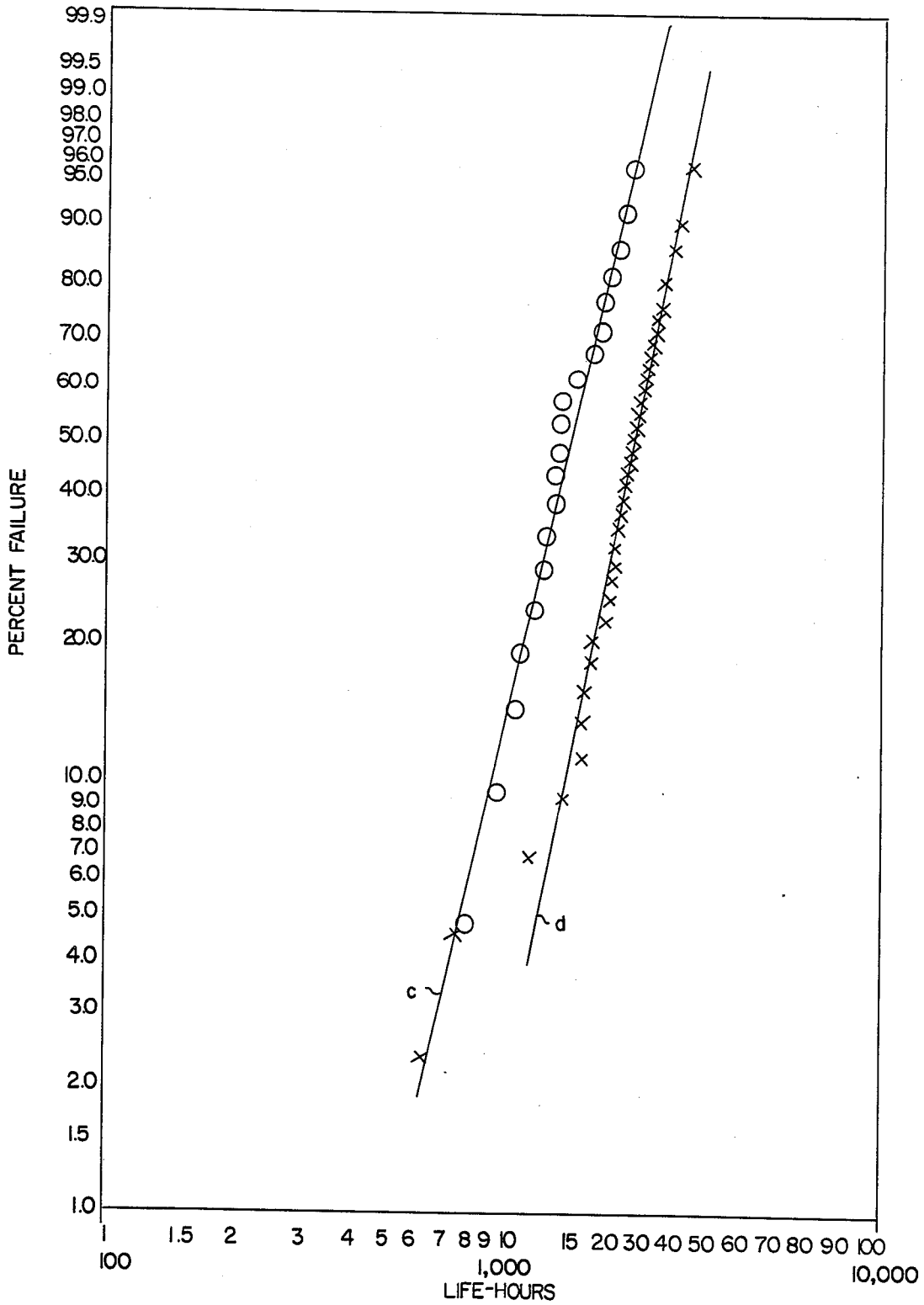

In FIG. 2, curve c illustrates the lamp test results for the control lamps including a phosphine getter. Curve d represents the test data for lamps fabricated in accordance with the present invention.

The use of silane as the oxygen getter resulted in a substantial life improvement of 45 percent.

The use of borane compound getters in incandescent lamps without the getter activation step will result in decomposition of the borane compound by the filament coil upon light-up of the lamp before gettering the contaminants in the lamp. Also, by not heating the capsules prior to coil light-up, adsorbed water on surfaces internal to the capsule is not released to be gettered by the additive prior to destruction of the additive by the coil. Furthermore, elevated temperatures are known to be needed to promote the rapid and complete reaction of even the highly active diborane in an excess of air. ("Fate of Pollutants in the Air and Water Environments," Part 2, pp. 167–192, 1977, by Edward I. Sowinski and Irwin H. Suffet.)

The present invention has been described in detail, including the preferred embodiments thereof. It will be appreciated that the skilled artisan, upon consideration of this disclosure, will be able to make modifications and/or improvements thereon, without departing from the spirit of the following claims.

What is claimed is:

1. A method of gettering an incandescent lamp comprising the steps of:

introducing a fill gas and a getter compound selected from the group consisting of a borane compound, a partially halogenated derivative thereof, and mixtures thereof, into an unsealed lamp envelope; sealing the lamp envelope; and heating the sealed envelope, for a sufficient period of time, and at a sufficient temperature, to activate the getter prior to its decomposition.

2. The method of claim 1, wherein the borane compound is $B_2H_6$.

3. The method of claim 1, wherein the borane compound is $B_4H_{10}$.

4. The method of claim 1, wherein the borane compound is $B_5H_9$.

5. The method of claim 1, wherein the borane compound is $B_5H_{11}$.

6. The method of claim 1, wherein the borane compound is $B_6H_{10}$.

7. The method of claim 1, wherein the borane compound is $B_6H_{12}$.

8. The method of claim 1, wherein the partially halogenated derivative of the borane compound has at least one, but less than all, of the hydrogens thereof replaced by bromine.

9. The method of claim 1, wherein the partially halogenated derivative of the borane compound has at least one, but less than all, of the hydrogens thereof replaced by chlorine.

10. The method of claim 1, wherein the partially halogenated derivative of the borane compound has at least one, but less than all, of the hydrogens thereof replaced by iodine.

11. The method of claim 1, wherein the partially halogenated derivative of the borane compound has at least one, but less than all, of the hydrogens thereof replaced by fluorine.

* * * * *